US008047362B2

(12) United States Patent
Pham et al.

(10) Patent No.: US 8,047,362 B2
(45) **Date of Patent: *Nov. 1, 2011**

(54) HINGE LID AROMA PACK

(75) Inventors: Xuan M. Pham, Glen Allen, VA (US); Scott A. Fath, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/755,717

(22) Filed: Apr. 7, 2010

(65) Prior Publication Data

US 2010/0193535 A1 Aug. 5, 2010

Related U.S. Application Data

(63) Continuation of application No. 11/443,658, filed on May 31, 2006, now Pat. No. 7,717,261.

(60) Provisional application No. 60/689,773, filed on Jun. 10, 2005.

(51) Int. Cl.
*B65D 85/10* (2006.01)

(52) U.S. Cl. ..... 206/271; 206/273

(58) Field of Classification Search ..... 206/268, 206/271, 273

See application file for complete search history.

(56) References Cited

U.S. PATENT DOCUMENTS

| | | | | |
|---|---|---|---|---|
| 3,516,846 | A | 6/1970 | Matson | |
| 3,516,941 | A | 6/1970 | Matson | |
| 3,599,859 | A | 8/1971 | Maierson | |
| 3,778,383 | A | 12/1973 | Schibler et al. | |
| 4,087,376 | A | 5/1978 | Foris et al. | |
| 4,089,802 | A | 5/1978 | Foris et al. | |
| 4,100,103 | A | 7/1978 | Foris et al. | |
| 4,251,386 | A | 2/1981 | Saeki et al. | |
| 4,717,017 | A | 1/1988 | Sprinkel, Jr. et al. | |
| 4,720,423 | A | 1/1988 | Fraser | |
| 4,847,124 | A | 7/1989 | Lux nee Andrieux et al. | |
| 5,000,486 | A | 3/1991 | Rua, Jr. et al. | |
| 5,249,676 | A | 10/1993 | Ashcraft et al. | |
| 5,938,018 | A | 8/1999 | Keaveney et al. | |
| 6,102,224 | A * | 8/2000 | Sun et al. | 215/252 |
| 6,164,444 | A | 12/2000 | Bray et al. | |
| 6,612,429 | B2 * | 9/2003 | Dennen | 206/268 |
| 6,658,822 | B1 | 12/2003 | Dittrich | |
| 7,717,261 | B2 * | 5/2010 | Pham et al. | 206/273 |
| 2002/0195355 | A1 | 12/2002 | Dennen | |
| 2005/0098948 | A1 | 5/2005 | Hronek | |

FOREIGN PATENT DOCUMENTS

| | | |
|---|---|---|
| EP | 0 297 959 | 1/1989 |
| GB | 1156725 | 7/1966 |
| GB | 2 041 319 | 9/1980 |
| GB | 2 048 206 | 12/1980 |

* cited by examiner

*Primary Examiner* — Jacob K Ackun

(74) *Attorney, Agent, or Firm* — Connolly Bove Lodge & Hutz LLP

(57) ABSTRACT

A hinge lid pack has a lower pack outerframe and an upper lid hingedly attached to the lower pack outerframe for movement between opened and closed positions. The lid includes front, top, back and opposite sidewall portions. An innerframe is within and upwardly extends from the outerframe, and the innerframe has front and opposite sidewall portions. Microencapsulated aroma surfaces on the pack move across roughened perforations on the pack upon opening of the pack to thereby release flavor by rupturing the microcapsules.

2 Claims, 2 Drawing Sheets

HINGE LID AROMA PACK

CROSS REFERENCE RELATED TO APPLICATION

The present application is a continuation of application Ser. No. 11/443,658, filed May 31, 2006, which is hereby incorporated by reference in its entirety. Application Ser. No. 11/443,658 claims the benefit of U.S. Provisional Application No. 60/689,773, filed Jun. 10, 2005.

BACKGROUND OF THE INVENTION

The present invention relates to a hinge lid aroma pack, and more particularly to a pack having aroma areas and roughened perforated areas that rub across the aroma areas when the hinge lid is opened to thereby release aroma to the consumer.

Microencapsulation is a process by which a core material is captured within a second material or shell. It is well known in the field to encapsulate aromas and flavors in shells of varying sizes so that the flavor is preserved until the rupture of the capsule by mechanical or other force. Preservation of the flavor within the capsule assures that upon release of the flavor it is as consistently strong as when it was first encapsulated. "Flavor," "fragrance," "aroma," and like terms are used interchangeably herein to indicate any substance that is capable of causing an olfactory sensation.

A multitude of processes exists for manufacturing microcapsules. A variety of techniques can be utilized to produce microcapsules of varying sizes, differing resistances to rupture and alternative capsule compositions and capsule constituents. Several different encapsulation processes are disclosed in U.S. Pat. Nos. 3,516,846; 3,516,941; 3,778,383; 4,087,376; 4,089,802; 4,100,103 and 4,251,386 and British Patent Specification Nos. 1,156,725; 2,041,319 and 2,048,206. Common shell formations include the polymerization reaction of urea and formaldehyde and the polycondensation of methylated urea and aldehydes.

One manner of an aroma-releasing pack is disclosed in U.S. Pat. No. 6,612,429 where encapsulated aroma areas on the inside of the lid are contacted by retention cuts or laterally projecting fins on the innerframe when the pack is opened to thereby release aroma by rupturing the microencapsulated aroma on those areas.

SUMMARY OF THE INVENTION

Among the objects of the present invention is the provision of a hinge lid aroma pack that releases a pleasing aroma to the consumer upon opening the pack.

It is a further object of the invention that the aroma is preserved against degradation until it is released upon opening of the pack.

The objects of the invention are achieved by incorporating flavorants into microcapsules or similar flavor encapsulating materials. The encapsulated flavorants are adhered to surfaces inside the pack so that the flavorant is released upon opening of the hinge lid pack. Placement of the encapsulated flavorants is determined by consideration of frictional contact between particular surfaces of the pack. The flavorant is released through frictional contact of the encapsulating materials on the pack with other structural elements of the pack.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 2:
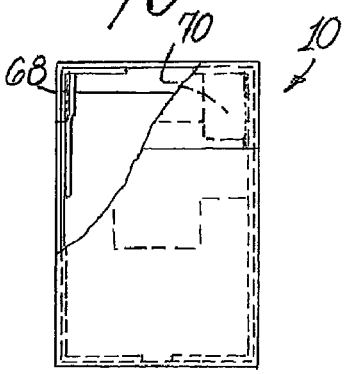
FIG. 2 is a front elevational view of the aroma packs shown in FIG. 1 with the lid closed and portions of the pack partially broken away to illustrate interior details.
Figure 3:
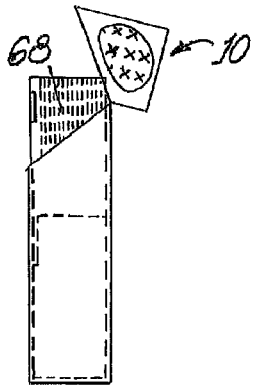
FIG. 3 is a side elevational view of the hinge lid aroma pack of FIGS. 1 and 2 with the lid open and portions of the pack partially broken away to illustrate a coated aroma area and a cooperating perforated panel.
Figure 4:
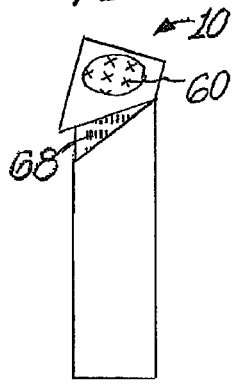
FIG. 4 is a side elevational view similar to FIG. 3 with the lid partially closed illustrating the perforated panel inside the lid rubbing against the coated aroma area.
Figure 5:
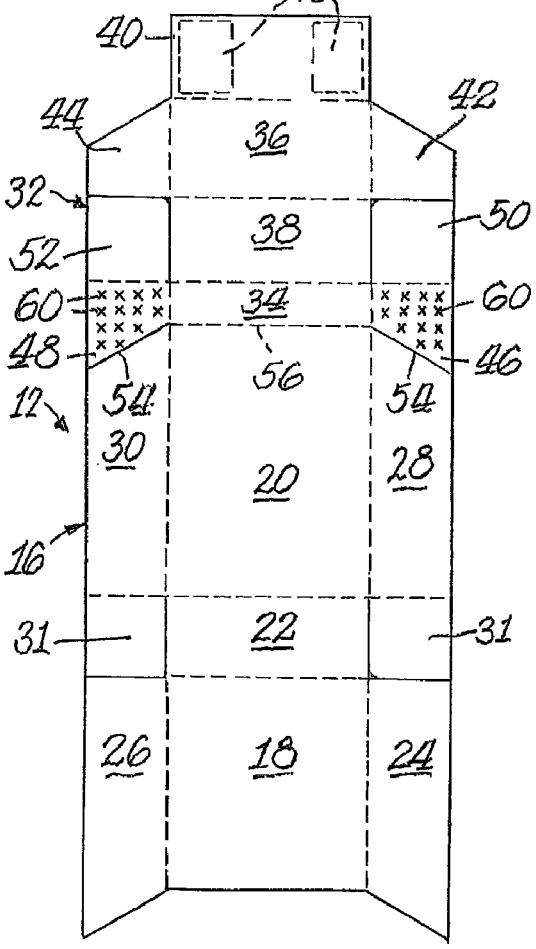
FIG. 5 is a top plan view of paperboard blank for forming the aroma pack shown in FIGS. 1-4.
Figure 1:
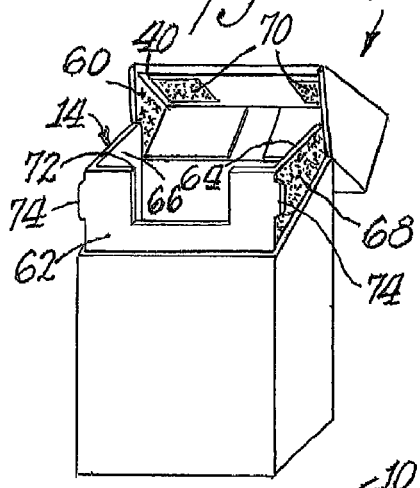
FIG. 1 is a perspective view of a hinge lid aroma pack with the lid open illustrating coated aroma areas and perforated panels, according to the present invention.
Figure 7:
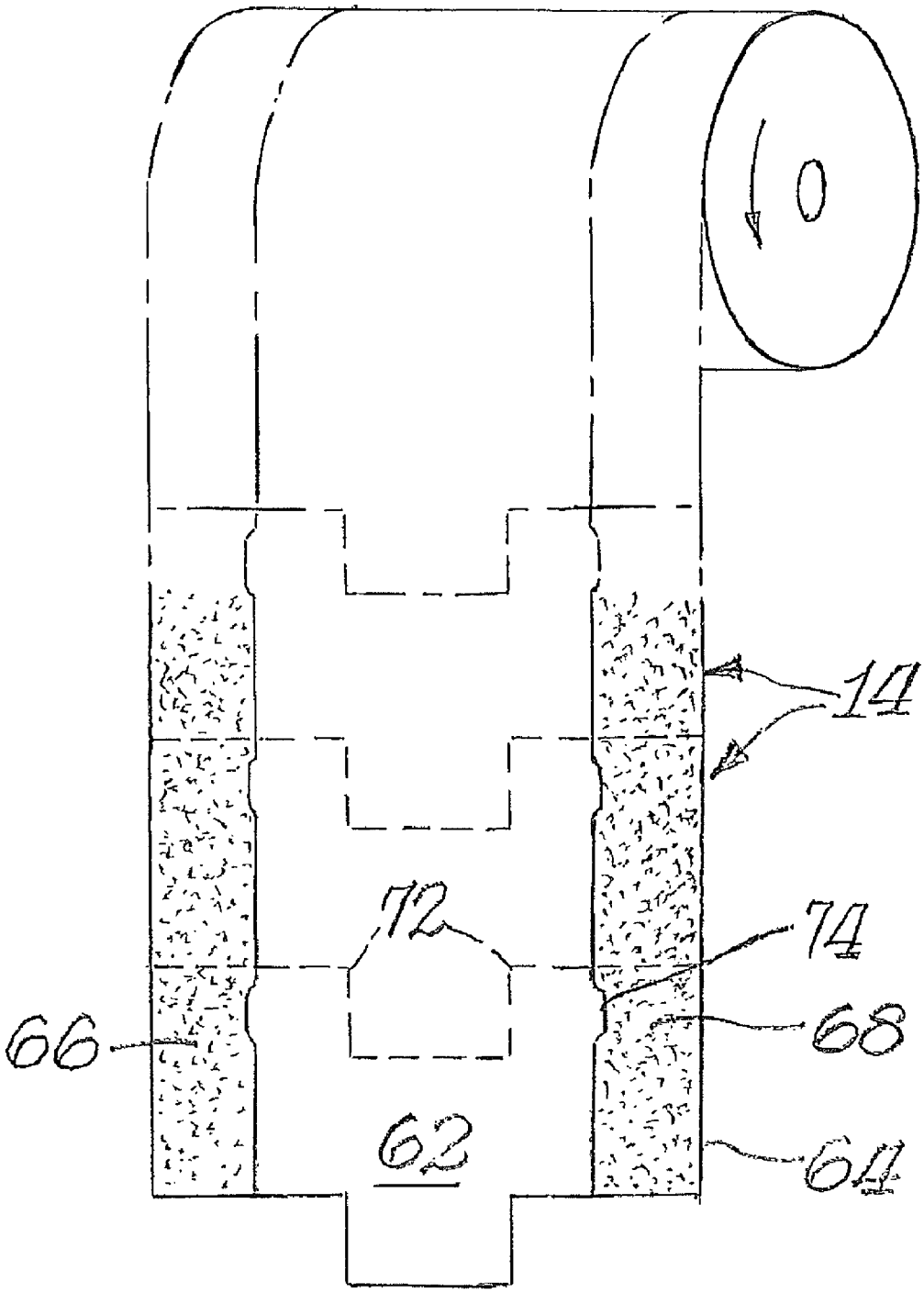
FIG. 7 is a perspective view of a continuous roll of material from which individual segments are cut to form the innerframe of the aroma pack of the present invention.

Referring in more particularity to the drawings, FIGS. 1-4 illustrate a hinge lid aroma pack 10 for packaging cigarettes, for example, according to the present invention, and FIG. 5 shows a blank 12 for producing the aroma pack. Blank 12 is folded into a pack shape and glued together as is well known in the art. Pack 10 also includes an innerframe 14, and a roll of such innerframes is shown in FIG. 7.

Referring to FIG. 5, blank 12 is made of cardboard or other paper stock, as is well known, and comprises a body forming portion or outerframe 16 including a front panel 18 and a back panel 20 integrally connected together by a bottom panel 22. A right side panel 24 and a left side panel 26 are integrally connected to the front panel, and a right side panel 28 and a left side panel 30 are integrally connected to the back panel, as shown. Bottom dust flaps 31 are connected to the right and left side panels 28, 30.

Blank 12 also has a lid forming portion 32 including a back panel 34 and a front panel 36 integrally connected by a top panel 38. Lid forming portion 32 also includes a reinforcing panel 40 which when reverse bent rests against front panel 36. Front panel 36 of lid forming portion 32 includes a right side panel 42 and a left side panel 44 integrally connected to the front panel 36 of the lid forming portion.

Right and left side panels 46,48, respectively, are integrally connected to back panel 34 of lid forming portion 32. Dust flaps 50, 52 for the lid adjacent the side panels 46, 48 function to close the edges between top panel 38 and the side panels of the lid forming portion. The dust flaps also reinforce the top 38 of the lid.

A 45° or other appropriate angle cut line 54 extends between side panels 28, 30 of body forming portion 16 and side panels 46, 48 of lid forming portion 32. Cut lines 54 merge into a hinge line 56 between the body and lid forming portions and about which the lid of the assembled cigarette pack 10 articulates relative to the body of the pack. Cut lines 54 enable such articulating to occur.

In the embodiment of the invention shown in FIGS. 1-5, the right and left side panels 46, 48 of the lid forming portion 32 each include a plurality of perforations 60 formed from the pack to the front of these panels. The front of each side panel 46, 48, as viewed in FIG. 5, presents a roughened surface that rubs across aroma coated areas of the lid to release aroma upon opening the pack 10, as explained more fully below.

As noted above, each pack 10 includes an innerframe 14 comprising a front panel 62 and right and left side panels 64, 66, positioned within the body forming portion 16 of the pack. The outer surface of the innerframe panels 64, 66 each include an aroma coating 68 of microencapsulated flavor substances, as explained throughout the specification. Accordingly, when an assembled pack is initially opened, the perforations 60 on each side panel 46, 48 of the lid forming portion 32 each present a roughened surface that rubs across the aroma coatings 68 on the outside of the side panels of the innerframe to thereby rupture the microencapsulated material and release aroma to the consumer. Thereafter, when the pack is closed and reopened the release of aroma continues, but to a lesser extent.

The reinforcing panel 40 of the lid forming portion 32 of the pack 10 also includes several areas of aroma coating 70 on the exposed surface of panel 40 when viewed inside the lid. Panel 40 engages the front panel 36 which positions the aroma coated areas 70 inside the lid behind the front panel. Upper edge portions 72 on the front panel 62 of innerframe 14 rub against the aroma panels when the pack is opened to thereby release flavor to the consumer by rupturing the microencapsulated aroma substances.

Figure 6:
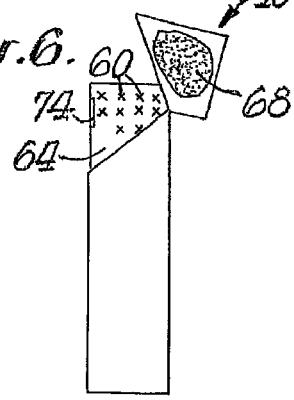
FIG. 6 is a side elevational view of an alterative hinge lid aroma pack with the perforated panel on the innerframe and the aroma coated area inside the lid.

FIG. 6 illustrates an alternate embodiment similar to the pack of FIGS. 1-5, but the pack 10' shown in FIG. 6 includes perforations 46 on the outside surfaces of the side panels 64, 66 of the innerframe 14. Aroma coatings 68 are provided on the inside surface of the right and left side panels 46, 48 of the lid forming portion 32. Accordingly, when the pack 10 is opened the roughened perforated surface on the innerframe rubs across the aroma coatings inside the lid to thereby release the encapsulated flavors. Also, the front panel 62 of the innerframe includes outwardly extending retention cuts 74 that rub across the inside aroma surface 68 on the panels 46, 48 of the lid to assist in rupturing the encapsulated flavor. Normally the retention cuts function to hold the lid closed, but in the present case they also function to rupture the microencapsules to thereby release aroma.

Microcapsules containing an aroma of choice are manufactured and can be obtained commercially from companies such as Arcade, Inc., Chattanooga, Tenn. Examples of potential aromas for encapsulation include peppermint and roasted/toasted aromas. However, almost any flavor oil may be encapsulated so long as it meets certain basic requirements of the technology, such as having hydrophobic qualities. A solution of polyoxymethylene urea polymer may be used to coat the flavor oils and produce the microcapsules after polymerization. The microcapsules may range in size from about 10 to about 40 micrometers in diameter.

The microcapsules may be obtained as a wet cake that can be combined with water to produce an "ink" slurry. Solvents are not utilized in combination with the cake as they may dissolve the polymer shell surrounding the microencapsulated aroma. A variety of concentrations will result in a usable ink slurry depending on the printing conditions and processes. For example, a 50% to 60% concentration of wet cake produces ink of consistency usable for gravure printing systems. In gravure printing press runs, 40 kilograms of ink at a 50% dilution concentration may yield enough ink to print approximately one million flip open boxes. Screen printing processes may also be used with microencapsulation inks.

Thus, a hinge lid pack is provided which is strategically coated with microencapsulated aroma oil ink so that frictional contact between a coated surface and other surfaces of the package occurs upon opening by the consumer. Frictional contact ruptures the microcapsules releasing a fragrant aroma to the consumer. One skilled in the art will appreciate that the present invention can be practiced by other than the described embodiments, which are presented for purposes of illustration and not limitation, and the present invention is limited only by the claims which follow.

The forgoing detailed description is primarily given for clearness of understanding and no unnecessary limitations are to be understood therefrom for modifications will become obvious to those skilled in the art upon reading this disclosure and may be made without the parting from the spirit of the invention or the scope of the appending claims.

What is claimed is:

1. A hinge lid pack comprising a lower pack outerframe and an upper lid hingedly attached to the lower pack outerframe for movement between opened and closed positions, the lid including front, top, back and opposite sidewall portions, an innerframe within and extending upwardly from the lower pack outerframe, the innerframe having front and opposite sidewall portions, microencapsulated aroma surfaces outside the opposite sidewall portions of the innerframe, and roughened surfaces inside the opposite side wall portions of the lid made by perforations therein whereby the microencapsulated aroma surfaces outside the opposite sidewall portions of the innerframe are ruptured by the roughened surfaces upon opening of the lid to thereby release aroma upon such opening.

2. A hinge lid pack as in claim 1 further including a microencapsulated aroma surface inside the front wall of the lid, and upper edge portions of the front wall of the innerframe constructed and arranged to engage inside the front wall of the lid when the pack is opened to thereby rupture the microencapsulated aroma surface thereon and release aroma upon such opening.

* * * * *